US005586950A

United States Patent [19]

Endo

[11] Patent Number: 5,586,950

[45] Date of Patent: Dec. 24, 1996

[54] GOLF BALL

[75] Inventor: Seiichiro Endo, Akashi, Japan

[73] Assignee: Sumitomo Rubber Industries, Ltd., Hyogo-ken, Japan

[21] Appl. No.: 365,949

[22] Filed: Dec. 29, 1994

[30] Foreign Application Priority Data

Dec. 29, 1993 [JP] Japan ..... 5-351591

[51] Int. Cl.[6] ..... A63B 37/12

[52] U.S. Cl. ..... 473/356; 473/373; 473/378

[58] Field of Search ..... 273/235 R; 473/356, 473/372, 371, 373, 378

[56] References Cited

U.S. PATENT DOCUMENTS

| | | | |
|---|---|---|---|
| 4,919,434 | 4/1990 | Saito | 273/235 R |
| 5,304,608 | 4/1994 | Yabuki et al. | 273/62 X |
| 5,314,187 | 5/1994 | Proudfit | 273/218 X |
| 5,439,227 | 8/1995 | Egashira et al. | 273/235 R X |
| 5,490,674 | 2/1996 | Hamada et al. | 473/373 |

FOREIGN PATENT DOCUMENTS

| | | |
|---|---|---|
| 0470854 | 12/1992 | European Pat. Off. . |
| 0613700 | 7/1994 | European Pat. Off. . |
| 2105595 | 3/1983 | United Kingdom . |
| 2277932 | 11/1994 | United Kingdom . |

*Primary Examiner*—George J. Marlo

*Attorney, Agent, or Firm*—Birch, Stewart, Kolasch & Birch, LLP

[57] ABSTRACT

The present invention provides a golf ball which exhibits a large flying distance and is superior in stability of iron shot and hit feeling.

The golf ball comprises a core and a cover for covering the core, the cover comprising two layers of an inner layer cover and an outer layer cover. A stiffness modulus of the inner layer cover is 3,000 to 5,500 kg/cm$^2$ and that of the outer layer cover being 1,000 to 2,500 kg/cm$^2$. A thickness of the inner layer cover is 0.5 to 2.5 mm and that of the outer layer being 0.5 to 2.5 mm. A total thickness of the inner layer cover and the outer layer cover is 1.0 to 4.5 mm. A base resin of the inner layer cover contains 5 to 100% by weight of an ionomer neutralized with a zinc ion.

6 Claims, 1 Drawing Sheet

GOLF BALL

FIELD OF THE INVENTION

The present invention relates to a golf ball. More particularly, it relates to a golf ball which exhibits a large flying distance and is superior in stability of iron shot and hit feeling.

BACKGROUND OF THE INVENTION

Heretofore, a balata cover has been used as the cover of the golf ball. However, an ionomer having excellent durability and cut resistance has recently been used as the base resin of the cover because the balata cover is inferior in durability and cut resistance. This ionomer cover is used not only as the cover of the solid golf ball but also the cover of the thread wound golf ball. The ionomer cover is exclusively used in the golf ball for ordinary golfers.

Further, an ionomer having high rigidity and high hardness is used for this ionomer cover for the purpose of increasing the flying distance by enhancing resilience performances.

However, the golf ball wherein the above ionomer having high rigidity and high hardness is used as the base resin of the cover, although exhibiting a large flying distance, has the following serious disadvantages the improvement thereof being desired.

(1) The feeling at the time of hitting is hard and the hit feeling is inferior because of the cover having high rigidity and high hardness.

(2) Since the cover has high rigidity and high hardness, sliding arises on the club face surface when hit with an iron club (hereinafter "iron shot"), the spin amount varies greatly, the flying distance is unstable, and the control properties are inferior.

In order to improve the above problems, a two-piece solid golf ball using a flexible resin having low rigidity as the cover has recently been marketed.

The golf ball using the above flexible cover material has solved the instability of the iron shot and hard hit feeling due to the cover. An extremely hard core is, however, required to be used in order to make up for deterioration in resilience performances caused by softening of the cover, and a new disadvantage is thus caused. That is, an excessive amount of spin is put on the golf ball, which results in serious deterioration in flying distance and, further, the impact force is increased and, therefore, the hit feeling becomes hard.

Therefore, there has been proposed a golf ball wherein the deterioration of flying distance caused by the softening of the cover is solved by constructing the cover with two layers; an inner layer cover and an outer layer cover composed of a soft resin and a rigid resin, respectively (Japanese Laid-Open Patent Publication No. 62-275480).

However, regarding the above golf ball, the rigid resin is used for the outer layer cover and, therefore, the hit feeling is hard and inferior. Further, slipping occurs on the face surface for the iron shot and the golf ball therefore lacks stability upon hitting.

As described above, a golf ball having performances which satisfies flying distance, stability of iron shot and hit feeling simultaneously has never been obtained, heretofore.

OBJECTS OF THE INVENTION

The main object of the present invention is to provide a golf ball which satisfies flying distance, stability of iron shot and hit feeling simultaneously, which have never been accomplished by a conventional golf ball.

This object as well as other objects and advantages of the present invention will become apparent to those skilled in the art from the following description with reference to the accompanying drawings.

SUMMARY OF THE INVENTION

Figure 1:
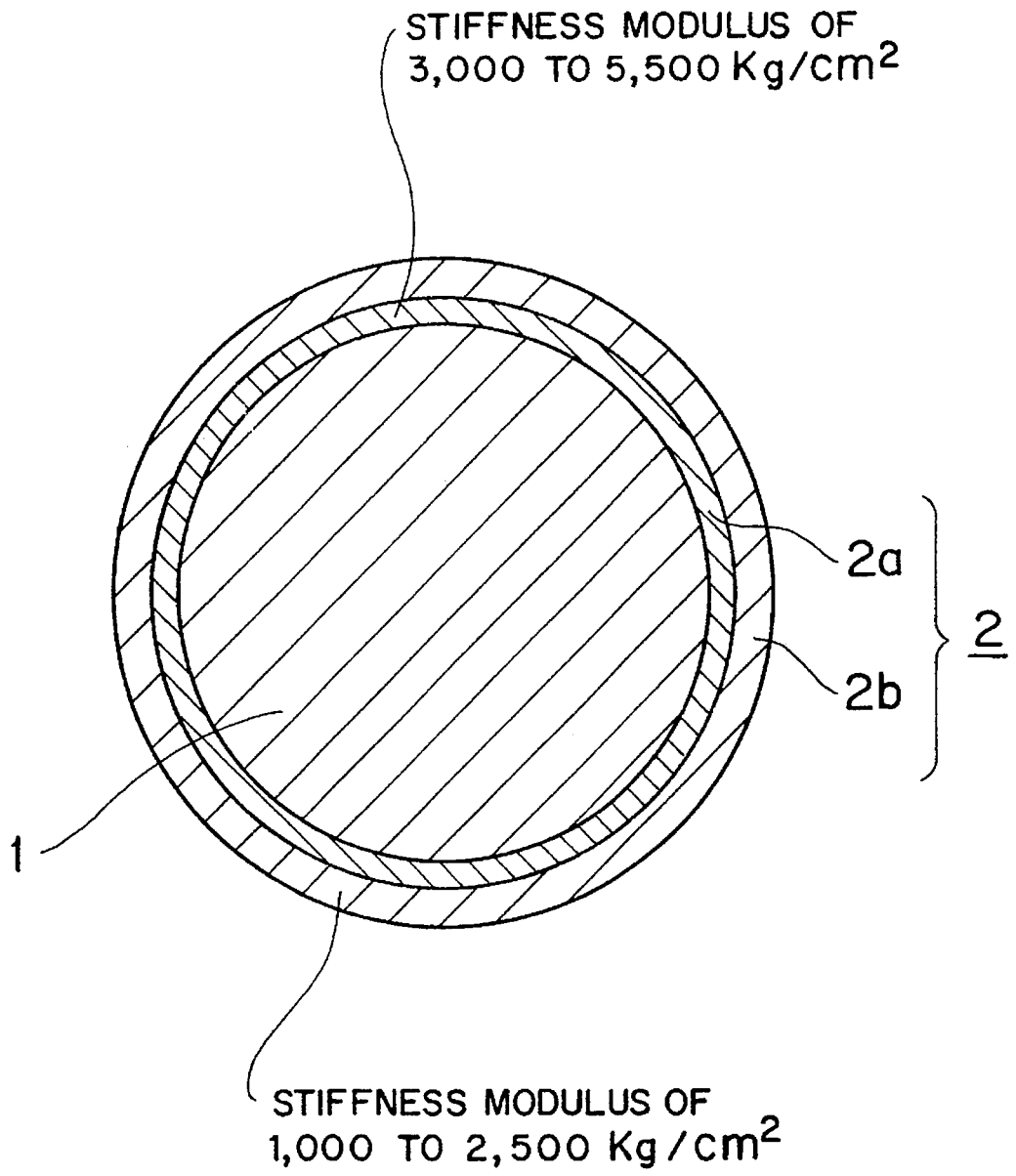
FIG. 1 is a schematic cross section illustrating one embodiment of the golf ball of the present invention.

The present invention provides a golf ball which exhibits a large flying distance and is superior in stability of iron shot, hit feeling and low temperature durability. The golf ball has a core and a cover for covering the core, the cover comprising two layers of an inner layer cover and an outer layer cover, a stiffness modulus of the inner layer cover being 3,000 to 5,500 kg/cm$^2$, a stiffness modulus of the outer layer cover being 1,000 to 2,500 kg/cm$^2$, a thickness of the inner layer cover being 0.5 to 2.5 mm, a thickness of the outer layer being 0.5 to 2.5 mm, a total thickness of the inner layer cover and the outer layer cover being 1.0 to 4.5 mm and a base resin of the inner layer cover containing 5 to 100% by weight of an ionomer neutralized with a zinc ion.

DETAILED DESCRIPTION OF THE INVENTION

The reason why the above effect can be accomplished in the present invention will be explained in turn with respect to stability of iron shot, flying distance and hit feeling.

(1) Stability of iron shot

Since the stiffness modulus of the outer layer cover is low (1,000 to 2,500 kg/cm$^2$) and the outer layer cover has low rigidity and is soft, no slipping occurs at the time of the shot and spin is liable to be put on the golf ball. Therefore, the control properties are improved and the variations in flying distance are prevented.

(2) Flying distance

Since the stiffness modulus of the inner layer cover is high (3,000 to 5,500 kg/cm$^2$) and the inner layer cover has high rigidity, the resilience performances of the golf ball and ball initial velocity are maintained at a suitable level.

That is, since the flexible cover having low rigidity is used for the outer layer and the high-rigid cover is used for the inner layer, the initial velocity of the ball is maintained at the suitable level without deterioration of resilience properties of the golf ball. Further, the flying distance of the golf ball is not deteriorated.

(3) Hit feeling

A soft feeling is obtained at the time of hitting due to the flexible outer layer cover having low rigidity, and light hit feeling having good resiliency is obtained due to the inner layer cover having high rigidity, which results in good hit feeling.

Next, the construction of the golf ball of the present invention will be explained with reference to the accompanying drawing.

FIG. 1 is a schematic cross section illustrating one embodiment of the golf ball of the present invention. In FIG. 1, 1 is a core and 2 is a cover for covering the core. This cover 2 comprises two layers, an inner layer cover 2*a* and an outer layer cover 2*b*. Dimples, painting or marking are normally provided on the cover 2, but they are omitted in FIG. 1.

The construction of the golf ball will be explained in detail with respect to the outer layer cover which contacts with the club at the time of hitting, the inner layer cover and the core in turn.

The thickness of the outer layer cover is 0.5 to 2.5 mm, preferably 0.6 to 2.3 mm. When the thickness of the outer layer cover is smaller than 0.5 mm, the durability such as cut resistance, etc. is deteriorated and it is difficult to conduct molding. Even if it can be molded, a part having a very small thickness is formed due to ununiformity of thickness and physical properties become unstable. Further, when the thickness of the outer layer cover is larger than 2.5 mm, the resilience performances of the golf ball are deteriorated because the outer layer cover has low rigidity and soft, which results in deterioration of flying distance.

Further, it is necessary that the outer layer cover has the stiffness modulus of 1,000 to 2,500 kg/cm$^2$, preferably 1,000 to 2,300 kg/cm$^2$, in view of physical properties.

As described above, the outer layer cover has low stiffness modulus in comparison with a conventional high-rigid cover (stiffness modulus: about 3,000 to 4,000 kg/cm$^2$) and stability of iron shot and good hit feeling can be obtained because of its low rigidity. When the stiffness modulus of the outer layer cover is higher than 2,500 kg/cm$^2$, the flexibility is lost, the hit feeling becomes hard and the slipping is arisen at the time of iron shot, which results in deterioration of safety. Further, the spin amount becomes unstable and the control properties become inferior. On the other hand, when the stiffness modulus of the outer layer cover is lower than 1,000 kg/cm$^2$, deterioration of resilience performances and cut resistance is arisen.

The thickness of the inner layer cover is 0.5 to 2.5 mm, preferably 0.6 to 2.3 mm. When the thickness of the inner layer cover is smaller than 0.5 mm, the resilience performances are deteriorated and it is difficult to conduct molding. Even if it can be molded, a part having a very small thickness is formed due to ununiformity of thickness and physical properties are unstable. Further, when the thickness of the inner layer cover is larger than 2.5 mm, the hit feeling is hard.

Further, it is necessary that the inner layer cover has the stiffness modulus of 3,000 to 5,500 kg/cm$^2$, preferably 3,200 to 5,000 kg/cm$^2$, in view of physical properties. That is, suitable resilience performances and ball initial velocity are obtained because the inner layer cover has the stiffness modulus within the above range.

When the stiffness modulus of the inner layer cover is lower than 3,000 kg/cm$^2$, deterioration of resilience performances and ball initial velocity arises and the hit feeling becomes heavy. On the other hand, when the stiffness modulus of the inner layer cover is higher than 5,500 kg/cm$^2$, it becomes too hard and the hit feeling becomes inferior.

As the base resin of the inner layer cover, ionomers having high rigidity or those containing the same as a main material are used. It is necessary that the base resin contains the ionomer neutralized with a zinc ion in an amount of 5 to 100% by weight, preferably 10 to 100% by weight. When the amount of the ionomer neutralized with a zinc ion is smaller than 5% by weight, the low temperature durability becomes inferior.

Examples of the ionomer having high rigidity include Hi-milane #1605, Hi-milane #1707, Hi-milane #1706 (trade name), etc. which are commercially available from Mitsui Du Pont Polychemical Co., Ltd., Iotek 7010, Iotek 8000 (trade name), etc. which are commercially available from Exxon Chemical Co. Examples of the ionomer having low rigidity include Hi-milane #1855, Hi-milane #1856 (trade name), etc. which are commercially available from Mitsui Du Pont Polychemical Co., Ltd. The stiffness modulus of the above Iotek 7010 (trade name) is not necessarily high, but the blend obtained by blending Iotek 7010 with the other ionomer has high rigidity. Therefore, Iotek 7010 is described as the ionomer having high rigidity.

Further, examples of the ionomer having medium rigidity include Himilane #1555 and Hi-milane #1557 (trade name) which are commercially available from Mitsui Du Pont Polychemical Co., Ltd. Examples of the resin having low rigidity include AD8265 and AD8269 [trade name, manufactured by Mitsui Du Pont Polychemical Co., Ltd.] as a terpolymer of an ethylene-methacrylic acid ionomer and an ester. The stiffness modulus of these resins will be explained in Examples hereinafter.

Examples of the resin having low rigidity include ethylene-isobutyl acrylate-methacrylic acid terpolymer resin which is commercially available from Mitsui Du Pont Polychemical Co., Ltd. under the trade name of Nucrel AN4212C and Nucrel NO825J (trade name); in addition to the above resins. Further, examples of the other low-rigid resin include ethylene-ethyl-acrylate-anhydrous maleic acid terpolymer resin which is commercially available from Sumitomo Chemical Co., Ltd. under the trade name of Bondine AX8390 and Bondine TX8030 (trade name). The base resin is not limited to the above resins.

As the base resin of the outer layer cover, the above resins may be used in combination so that the stiffness modulus may be within a range from 1,000 to 2,500 kg/cm$^2$. Further, it is preferred that the base resin of the outer layer contains 5 to 100% by weight of an ionomer neutralized with a zinc ion.

The base resin of the inner cover layer contains 5 to 100% by weight of an ionomer neutralized with a zinc ion. Examples of the ionomer neutralized with a zinc ion include Hi-milane #1706, Hi-milane #1557, Hi-milane #1855, Iotek 7010 and the like. The base resin containing 5 to 100% by weight of the ionomer may have a stiffness modulus of 3,000 to 5,500 kg/cm$^2$.

A composition for cover to be used for forming the outer layer cover and inner layer cover is prepared by formulating pigments such as titanium dioxide, barium sulfate, etc. and, if necessary, antioxidants into the above base resin. Further, the other resin may be added to the above base resin unless characteristics of the above base resin are deteriorated.

In the present invention, any core for a solid golf ball or a thread wound golf ball can be used.

The solid core may be a core for a two-piece golf ball or a core for a multi-layer structure golf ball having three layers or more. For example, as the core for a two-piece golf ball, those obtained by subjecting a rubber composition to press vulcanization to compress with heating (e.g. at a temperature of 140° to 170° C. for 10 to 40 minutes) into a spherical vulcanized article can be used; said rubber composition being prepared by formulating 10 to 60 parts by weight of at least one vulcanizing agent (crosslinking agent) of α,β-ethylenically unsaturated carboxylic acids (e.g. acrylic acid, methacrylic acid, etc.) or metal salts thereof and functional monomers (e.g. trimethylolpropane trimethacrylate, etc.), 5 to 40 parts by weight of a filler (e.g. zinc oxide, barium sulfate, etc.), 0.5 to 5 parts by weight of a peroxide (e.g. dicumyl peroxide, etc.) and, if necessary, 0.1 to 1 part by weight of an antioxidant, based on 100 parts by weight of polybutadiene rubber. It is preferred that the diameter of the core is 36.5 to 43.0 mm.

The thread wound core is composed of a center and a thread rubber wound on the center. As the center, any of a liquid center and a rubber center can be used. As the rubber center, there can be used those obtained by vulcanizing the same rubber composition as that of the solid core.

The thread rubber may be those which have hitherto been used. For example, there can be used those obtained by vulcanizing a rubber composition wherein an antioxidant, a vulcanizing accelerator and sulfur are formulated in a natural rubber or a natural rubber and synthetic polyisoprene. The core is not limited to the solid core and thread wound core.

A method of coating the inner layer cover on the core is not specifically limited, but may be a normal method. For example, there can be employed a method comprising molding a composition for inner layer cover into a semi-spherical half-shell in advance, covering a core with two half-shells and then subjecting to a pressure molding at 130° to 170° C. for 1 to 15 minutes, or a method comprising subjecting the composition for inner layer cover to an injection molding directly to cover the core. The outer layer cover is coated on the inner layer cover according to the same manner as that of coating the inner layer cover on the core. In case of molding of the outer layer cover, a dimple may be formed on the surface of the ball, if necessary. Further, if necessary, a paint finishing and stamping may be provided after cover molding.

As explained above, the golf ball of the present invention exhibits a large flying distance and is superior in stability of iron shot and hit feeling.

The following Examples and Comparative Examples further illustrate the present invention in detail but are not to be construed to limit the scope thereof.

EXAMPLES

Examples 1 to 13 and Comparative Examples 1 to 14

In order to prepare a core used in the following Examples and Comparative Examples, a composition for core was prepared using the formulation components shown in Table 1.

The respective compositions for core thus obtained were charged in a die and vulcanized at 155° C. for 40 minutes to prepare a core. Further, the amount in Table 1 is "parts by weight". A diameter of the core varies depending on a thickness of the cover so that an outer diameter of the golf ball may become 42.7 mm, and is within a range from 35.7 to 38.3 mm.

TABLE 1

| | A | B | C |
|---|---|---|---|
| Butadiene rubber*[1] | 100 | 100 | 100 |
| Zinc acrylate | 30 | 30 | 30 |
| Zinc oxide | 22 | 20 | 18 |
| Antioxidant*[2] | 0.5 | 0.5 | 0.5 |
| Dicumyl peroxide | 2.5 | 2.5 | 2.5 |

*[1]Hi-cis butadiene rubber, JSR BR01 (trade name) manufactured by Nihon Synthetic Rubber Co., Ltd.
*[2]Yoshinox 425 (trade name) manufactured by Yoshitomi Seiyaku Co., Ltd.

A core A is used for Examples 1 to 10, Example 13, Comparative Examples 1 to 4 and Comparative Examples 7 to 14, a core B is used for Examples 11 and 12 and a core C is used for Comparative Examples 5 and 6. The core which is different from the others is used for Examples 11 and 12 and Comparative Examples 5 and 6 because the ball weight must be adjusted within a range of 45.3±0.1 g.

Then, a composition for inner layer cover and a composition for outer layer cover used in the Examples and Comparative Examples were prepared using the formulation components shown in Tables 2 and 3. The amount of each component in Tables 2 and 3 is "parts by weight". Each resin was described by its trade name and its composition and description is set forth at the end of Table 3.

Further, in Tables 2 and 3, there are described a stiffness modulus of each composition for cover and an amount of ionomer neutralized with a zinc ion. This ionomer neutralized with a zinc ion is described at the top part in Tables 2 and 3. Titanium dioxide ($TiO_2$) is formulated in each composition for cover in an amount of 2 parts by weight based on 100 parts by weight of the resin component, but the amount is not described in Tables 2 and 3.

Each composition for cover was prepared by mixing formulation materials using a kneading type twin-screw extruder. The extrusion conditions are as follows: a screw diameter: 45 mm; a screw revolution per minute: 200 rpm; a screw L/D: 35.

TABLE 2

| | | | A | B | C | D | E | F | G |
|---|---|---|---|---|---|---|---|---|---|
| Hi-milane | #1706 | *3 | 50 | 30 | — | 10 | 30 | 85 | 100 |
| Hi-milane | #1557 | *4 | — | — | — | — | — | — | — |
| Hi-milane | #1855 | *5 | — | 20 | — | — | — | — | — |
| Iotek | #7010 | *6 | — | — | 50 | — | — | — | — |
| Hi-milane | #1605 | *7 | 35 | 50 | — | — | 30 | — | — |
| Hi-milane | #1707 | *8 | 15 | — | — | 65 | 30 | 15 | — |
| Hi-milane | #1555 | *9 | — | — | — | 25 | 10 | — | — |
| Hi-milane | #1856 | *10 | — | — | — | — | — | — | — |
| AD8265 | | *11 | — | — | — | — | — | — | — |
| AD8269 | | *12 | — | — | — | — | — | — | — |
| Iotek | #8000 | *13 | — | — | 50 | — | — | — | — |
| Stiffness modulus ($Kg/cm^2$) | | | 3500 | 3000 | 4000 | 3500 | 3500 | 3500 | 3100 |
| Amount (% by weight) of ionomer neutralized with zinc ion | | | 50 | 50 | 50 | 10 | 30 | 85 | 100 |

TABLE 3

| | | H | I | J | K | L | M | N | O |
|---|---|---|---|---|---|---|---|---|---|
| Hi-milane | #1706 | 25 | — | 20 | — | — | 20 | — | — |
| Hi-milane | #1557 | — | 30 | 10 | 10 | — | 60 | — | 20 |
| Hi-milane | #1855 | 25 | 70 | 30 | 20 | 100 | — | — | 80 |
| Iotek | #7010 | — | — | — | — | — | — | — | — |
| Hi-milane | #1605 | 25 | — | — | — | — | 20 | 100 | — |
| Hi-milane | #1707 | — | — | — | — | — | — | — | — |
| Hi-milane | #1555 | 20 | — | — | — | — | — | — | — |
| Hi-milane | #1856 | 15 | — | — | — | — | — | — | — |
| AD8265 | | — | — | 40 | 20 | — | — | — | — |
| AD8269 | | — | — | — | 50 | — | — | — | — |
| Iotek | #8000 | — | — | — | — | — | — | — | — |
| Stiffness modulus ($Kg/cm^2$) | | 2500 | 1500 | 1500 | 700 | 900 | 2000 | 3300 | 1200 |
| Amount (% by weight) of ionomer neutralized with zinc ion | | 50 | 100 | 60 | 30 | 100 | 80 | 0 | 100 |

※3: Hi-milane #1706 (trade name):

ethylene-methacrylic acid ionomer obtained by neutralizing with a zinc ion manufactured by Mitsui Du Pont Polychemical Co., MI (melt index)=0.7, stiffness modulus=2,600 $kg/cm^2$ ※4: Hi-milane #1557 (trade name):

ethylene-methacrylic acid ionomer obtained by neutralizing with a zinc ion manufactured by Mitsui Du Pont Polychemical Co., MI=1.0, stiffness modulus=2,100 $kg/cm^2$ ※5: Hi-milane #1855 (trade name):

ethylene-methacrylic acid ionomer obtained by neutralizing with a zinc ion manufactured by Mitsui Du Pont Polychemical Co., MI=1.0, stiffness modulus=900 $kg/cm^2$ ※6: Iotek 7010 (trade name):

ethylene-acrylic acid ionomer obtained by neutralizing with a zinc ion manufactured by Exxon Chemical Co., MI=1.0, stiffness modulus=1,600 $kg/cm^2$ ※7: Hi-milane #1605 (trade name):

ethylene-methacrylic acid ionomer obtained by neutralizing with a sodium ion manufactured by Mitsui Du Pont Polychemical Co., MI=2.8, stiffness modulus=3, 100 $kg/cm^2$ ※8: Hi-milane #1707 (trade name):

ethylene-methacrylic acid ionomer obtained by neutralizing with a sodium ion manufactured by Mitsui Du Pont Polychemical Co., MI=0.9, stiffness modulus=3, 000 $kg/cm^2$ ※9: Hi-milane #1555 (trade name):

ethylene-methacrylic acid ionomer obtained by neutralizing with a sodium ion manufactured by Mitsui Du Pont Polychemical Co., MI=1.0, stiffness modulus=2, 100 $kg/cm^2$ ※10: Hi-milane #1856 (trade name):

ethylene-methacrylic acid-acrylate terpolymer obtained by neutralizing with a sodium ion manufactured by Mitsui Du Pont Polychemical Co., MI=1.0, stiffness modulus=700 $kg/cm^2$ ※11:AD8265 (trade name):

ethylene-methacrylic acid-methacrylate terpolymer obtained by neutralizing with a sodium ion manufactured by Mitsui Du Pont Polychemical Co., MI=1.9, stiffness modulus: 700 $kg/cm^2$ ※12:AD8269 (trade name):

ethylene-methacrylic acid-acrylate terpolymer obtained by neutralizing with a sodium ion manufactured by Mitsui Du Pont Polychemical Co., MI=0.8, stiffness modulus=400 $kg/cm^2$ ※13: Iotek 8000 (trade name):

ethylene-acrylic acid ionomer obtained by neutralizing with a sodium ion manufactured by Exxon Chemical Co., MI=0.8, stiffness modulus=3,800 $kg/cm^2$ Then, a combination of the inner layer cover and outer layer cover as shown in Tables 4, 6, 8, 10, 12 and 14 was coated on the above core to prepare a golf ball. The preparation method is as shown below.

Firstly, a semi-spherical half-shell was molded from a composition for inner layer cover, and the above core was covered with two half-shells and subjected to a press molding in a die at 150% for 8 minutes.

Similarly, a half-shell was molded from a composition for outer layer cover, and the core coated with the inner layer cover was covered with two half-shells and subjected to a press molding in a die for golf ball at 150° C. for 8 minutes to obtain a golf ball. The resulting golf ball was painted to give a coated golf ball of 42.7 mm in diameter. Each golf ball has a weight of not more than 45.4 g and satisfies the standard of the weight.

Then, the ball compression (PGA system), the durability, the low temperature durability, the flying performances, the control properties by means of iron and the hit feeling of the resulting golf ball were examined. The results are shown in the following tables. The measuring method thereof is as follows.

Durability:

A golf ball was hit with a No. 1 wood club at a head speed of 45 m/second using a swing robot manufactured by True Temper Co., and the number of times until breakage was arisen was measured. The resulting value was indicated as an index in case of the value of the golf ball of Example 1 being 100.

Low temperature durability:

A golf ball was maintained at −20° C. and hit with a No. 1 wood club at a head speed of 45 m/second 50 times using a swing robot manufactured by True Temper Co. Test was conducted as to ten golf balls. The results are evaluated by the following criteria:

○: All ten golf balls were not broken.

X: One or more golf balls were broken.

Flying performances:

Flying performances are examined by hitting the golf ball with a No. 1 wood club (wood #1) and a No. 9 iron club (iron #9) using a swing robot manufactured by True Temper Co.

The golf ball was hit with the No. 1 wood club at a head speed of 45 m/second to measure the initial velocity and the carry (distance up to the point where the golf ball was dropped).

The golf ball was hit with the No. 9 iron club at a head speed of 34 m/second to measure the spin, the carry, the run (distance of the golf ball from the point where the golf ball was dropped) and the total (total of the carry and the run). The spin is determined by taking a photograph of the golf ball.

Control properties by means of iron:

It is evaluated by hitting the golf ball by 10 top professional golfers. The evaluation was conducted by the following criteria:

o: The golf ball is liable to be stopped by a short iron, control properties are good.

X: The golf ball is not easily stopped by a short iron, control properties are inferior.

Hit feeling:

It is evaluated by hitting the golf ball by 10 top professional golfers. The evaluation was conducted by the following criteria:

o: Soft feeling similar to that of a balata thread wound golf ball, and resiliency is good Δ: Soft feeling X H: Hard and inferior X S: Too soft and heavy, and resiliency is inferior In Tables 4 to 15, the kind (indicated by the symbol in Tables 2 to 3), the stiffness modulus, the amount of the ionomer neutralized with a zinc ion (represented by the "proportion of Zn") and the thickness of the composition for inner layer cover, the kind, the stiffness modulus and the thickness of the composition for outer layer cover, the total thickness of the cover of the golf ball, the compression, the durability, the low temperature durability, the flying performances (No. 1 wood club is represented by "wood #1" and No. 9 iron club is represented by "iron #9"), the control properties and hit feeling by means of iron are shown according to the respective Examples and

Comparative Examples

Further, regarding the golf balls of Comparative Examples 8 to 11, the cover is composed of a single layer and, therefore, the composition for the cover, the stiffness modulus and the thickness are shown in the item of the "outer layer cover". Further, since the golf ball of Comparative Example 12 is a commercially available thread wound golf ball with balata cover, the description about the cover in the table is omitted.

TABLE 4

| | Example No. | | | | |
|---|---|---|---|---|---|
| | 1 | 2 | 3 | 4 | 5 |
| Inner layer cover | | | | | |
| Composition for cover | B | A | C | A | A |
| Stiffness modulus ($kg/cm^2$) | 3000 | 3500 | 4000 | 3500 | 3500 |
| Proportion (% by weight) of Zn | 50 | 50 | 50 | 50 | 50 |
| Thickness (mm) | 1.5 | 1.5 | 1.5 | 1.5 | 1.5 |
| Outer layer cover | | | | | |
| Composition for cover | I | I | I | O | M |
| Stiffness modulus ($kg/cm^2$) | 1500 | 1500 | 1500 | 1200 | 2000 |
| Thickness (mm) | 0.7 | 0.7 | 0.7 | 0.7 | 0.7 |
| Characteristics of ball | | | | | |
| Total thickness of cover (mm) | 2.2 | 2.2 | 2.2 | 2.2 | 2.2 |
| Compression | 98.0 | 98.5 | 99.0 | 98.0 | 99.0 |
| Durability | 102 | 100 | 98 | 102 | 99 |
| Low temperature durability | O | O | O | O | O |

TABLE 5

| | Example No. | | | | |
|---|---|---|---|---|---|
| | 1 | 2 | 3 | 4 | 5 |
| Flying performances | | | | | |
| Wood #1 | | | | | |
| Ball initial velocity (m/second) | 65.5 | 65.7 | 65.9 | 65.6 | 65.8 |
| Carry (yard) | 232 | 233 | 234 | 233 | 233.5 |
| Iiron #9 | | | | | |
| Spin (rpm) | 8300 | 8250 | 8200 | 8400 | 8200 |
| Carry (yard) | 135.0 | 135.5 | 136.0 | 134.5 | 135.5 |
| Run (yard) | 0.5 | 0.5 | 0.5 | 0.5 | 0.5 |
| Total (yard) | 135.5 | 136.0 | 136.5 | 135.0 | 136.0 |
| Control properties by means of iron | O | O | O | O | O |
| Hit feeling | O | O | O | O | O |

TABLE 6

| | Example No. | | | | |
|---|---|---|---|---|---|
| | 6 | 7 | 8 | 9 | 10 |
| Inner layer cover | | | | | |
| Composition for cover | A | D | E | F | G |
| Stiffness modulus ($kg/cm^2$) | 3500 | 3500 | 3500 | 3500 | 3100 |
| Proportion (% by weight) of Zn | 50 | 5 | 30 | 85 | 100 |
| Thickness (mm) | 1.5 | 1.5 | 1.5 | 1.5 | 1.5 |
| Outer layer cover | | | | | |
| Composition for cover | H | I | I | I | I |
| Stiffness modulus ($kg/cm^2$) | 2500 | 1500 | 1500 | 1500 | 1500 |
| Thickness (mm) | 0.7 | 0.7 | 0.7 | 0.7 | 0.7 |
| Characteristics of ball | | | | | |
| Total thickness of cover (mm) | 2.2 | 2.2 | 2.2 | 2.2 | 2.2 |
| Compression | 99.5 | 98.5 | 98.5 | 98.5 | 98.0 |
| Durability | 98 | 100 | 100 | 100 | 101 |
| Low temperature durability | O | O | O | O | O |

TABLE 7

| | Example No. | | | | |
|---|---|---|---|---|---|
| | 6 | 7 | 8 | 9 | 10 |
| Flying performances | | | | | |
| Wood #1 | | | | | |
| Ball initial velocity (m/second) | 66.0 | 65.7 | 65.7 | 65.7 | 65.5 |
| Carry (yard) | 234.5 | 233 | 233 | 233 | 232 |
| Iiron #9 | | | | | |
| Spin (rpm) | 8100 | 8250 | 8250 | 8250 | 8300 |
| Carry (yard) | 136.0 | 135.5 | 135.5 | 135.5 | 135.0 |
| Run (yard) | 0.5 | 0.5 | 0.5 | 0.5 | 0.5 |
| Total (yard) | 136.5 | 136.0 | 136.0 | 136.0 | 135.5 |
| Control properties by means of iron | ○ | ○ | ○ | ○ | ○ |
| Hit feeling | ○ | ○ | ○ | ○ | ○ |

TABLE 8

| | Example No. | | |
|---|---|---|---|
| | 11 | 12 | 13 |
| Inner layer cover | | | |
| Composition for cover | A | A | A |
| Stiffness modulus (kg/cm$^2$) | 3500 | 3500 | 3500 |
| Proportion (% by weight) of Zn | 50 | 50 | 50 |
| Thickness (mm) | 0.5 | 2.5 | 1.5 |
| Outer layer cover | | | |
| Composition for cover | I | I | J |
| Stiffness modulus (kg/cm$^2$) | 1500 | 1500 | 1500 |
| Thickness (mm) | 2.5 | 0.5 | 0.7 |
| Characteristics of ball | | | |
| Total thickness of cover (mm) | 3.0 | 3.0 | 2.2 |
| Compression | 97.0 | 99.5 | 98.5 |
| Durability | 103 | 101 | 100 |
| Low temperature durability | ○ | ○ | ○ |

TABLE 9

| | Example No. | | |
|---|---|---|---|
| | 11 | 12 | 13 |
| Flying performances | | | |
| Wood #1 | | | |
| Ball initial velocity (m/second) | 65.4 | 65.9 | 65.7 |
| Carry (yard) | 231.5 | 234 | 233 |
| Iiron #9 | | | |
| Spin (rpm) | 8450 | 8200 | 8250 |
| Carry (yard) | 134.5 | 136.0 | 135.5 |
| Run (yard) | 0.5 | 0.5 | 0.5 |
| Total (yard) | 135.0 | 136.5 | 136.0 |
| Control properties by means of iron | ○ | ○ | ○ |
| Hit feeling | ○ | ○ | ○ |

TABLE 10

| | Comparative Example No. | | | | |
|---|---|---|---|---|---|
| | 1 | 2 | 3 | 4 | 5 |
| Inner layer cover | | | | | |
| Composition for cover | H | A | A | N | A |
| Stiffness modulus (kg/cm$^2$) | 2500 | 3500 | 3500 | 3300 | 3500 |
| Proportion (% by weight) of Zn | 50 | 50 | 50 | 0 | 50 |
| Thickness (mm) | 1.5 | 1.5 | 1.5 | 1.5 | 0.5 |
| Outer layer cover | | | | | |
| Composition for cover | I | K | B | I | I |
| Stiffness modulus (kg/cm$^2$) | 1500 | 700 | 3000 | 1500 | 1500 |
| Thickness (mm) | 0.7 | 0.7 | 0.7 | 0.7 | 3.0 |
| Characteristics of ball | | | | | |
| Total thickness of cover (mm) | 2.2 | 2.2 | 2.2 | 2.2 | 3.5 |
| Compression | 97.5 | 97.5 | 100.0 | 98.5 | 97.0 |
| Durability | 103 | 104 | 94 | 100 | 104 |
| Low temperature durability | ○ | ○ | ○ | X | ○ |

TABLE 11

| | Comparative Example No. | | | | |
|---|---|---|---|---|---|
| | 1 | 2 | 3 | 4 | 5 |
| Flying performances | | | | | |
| Wood #1 | | | | | |
| Ball initial velocity (m/second) | 65.2 | 65.4 | 66.2 | 65.6 | 65.0 |
| Carry (yard) | 229.5 | 230 | 235.5 | 232.5 | 228.5 |
| Iiron #9 | | | | | |
| Spin (rpm) | 8400 | 8350 | 7700 | 8250 | 8550 |
| Carry (yard) | 132.0 | 133.0 | 135.0 | 135.5 | 132.0 |
| Run (yard) | 0.5 | 0.5 | 2.5 | 0.5 | 0.5 |
| Total (yard) | 132.5 | 133.5 | 137.5 | 136.0 | 132.5 |
| Control properties by means of iron | ○ | ○ | X | ○ | ○ |
| Hit feeling | XS | XS | XH | ○ | XS |

TABLE 12

| | Comparative Example No. | | | | |
|---|---|---|---|---|---|
| | 6 | 7 | 8 | 9 | 10 |
| Inner layer cover | | | | | |
| Composition for cover | A | I | — | — | — |
| Stiffness modulus (kg/cm$^2$) | 3500 | 1500 | — | — | — |
| Proportion (% by weight) of Zn | 50 | 100 | — | — | — |
| Thickness (mm) | 3.0 | 1.5 | — | — | — |
| Outer layer cover | | | | | |
| Composition for cover | I | A | I | H | A |
| Stiffness modulus (kg/cm$^2$) | 1500 | 3500 | 1500 | 2500 | 3500 |
| Thickness (mm) | 0.5 | 0.7 | 2.2 | 2.2 | 2.2 |
| Characteristics of ball | | | | | |
| Total thickness of cover (mm) | 3.5 | 2.2 | 2.2 | 2.2 | 2.2 |
| Compression | 100.0 | 96.0 | 95.5 | 96.5 | 98.5 |
| Durability | 98 | 90 | 105 | 102 | 92 |
| Low temperature durability | ○ | ○ | ○ | ○ | ○ |

TABLE 13

| | Comparative Example No. | | | | |
|---|---|---|---|---|---|
| | 6 | 7 | 8 | 9 | 10 |
| Flying performances | | | | | |
| Wood #1 | | | | | |
| Ball initial velocity (m/second) | 66.1 | 65.1 | 64.7 | 65.2 | 65.6 |
| Carry (yard) | 234.5 | 229.0 | 226.5 | 229.5 | 234.0 |
| Iiron #9 | | | | | |
| Spin (rpm) | 7700 | 7650 | 8600 | 8200 | 7600 |
| Carry (yard) | 136.5 | 132.5 | 127.0 | 130.0 | 136.0 |
| Run (yard) | 2.5 | 2.0 | 0.5 | 0.5 | 2.5 |
| Total (yard) | 139.0 | 134.5 | 127.5 | 130.5 | 138.5 |
| Control properties by means of iron | X | X | ○ | ○ | X |
| Hit feeling | XH | XH | XS | XS | XH |

TABLE 14

| | Comparative Example No. | | | |
|---|---|---|---|---|
| | 11 | 12 | 13 | 14 |
| Inner layer cover | | | | |
| Composition for cover | — | — | N | N |
| Stiffness modulus (kg/cm$^2$) | — | — | 3300 | 3300 |
| Proportion (% by weight) of Zn | — | — | 0 | 0 |
| Thickness (mm) | — | — | 1.5 | 0.7 |
| Outer layer cover | | | | |
| Composition for cover | C | — | L | L |
| Stiffness modulus (kg/cm$^2$) | 4000 | — | 900 | 900 |
| Thickness (mm) | 2.2 | — | 0.7 | 1.5 |
| Characteristics of ball | | | | |
| Total thickness of cover (mm) | 2.2 | — | 2.2 | 2.2 |
| Compression | 99.5 | 95.0 | 98.0 | 97.0 |
| Durability | 88 | 70 | 104 | 107 |
| Low temperature durability | ○ | ○ | X | X |

TABLE 15

| | Comparative Example No. | | | |
|---|---|---|---|---|
| | 11 | 12 | 13 | 14 |
| Flying performances | | | | |
| Wood #1 | | | | |
| Ball initial velocity (m/second) | 66.3 | 64.8 | 65.3 | 65.0 |
| Carry (yard) | 235.5 | 228.5 | 230.0 | 228.5 |
| Iiron #9 | | | | |
| Spin (rpm) | 7400 | 8700 | 8350 | 8450 |
| Carry (yard) | 137.0 | 129.5 | 134.0 | 133.0 |
| Run (yard) | 3.0 | 0.5 | 0.5 | 0.5 |
| Total (yard) | 140.0 | 130.0 | 134.5 | 133.5 |
| Control properties by means of iron | X | ○ | ○ | ○ |
| Hit feeling | XH | Δ | XS | XS |

Firstly, a golf ball for comparison will be explained. Among the golf balls of the above Comparative Examples, the golf ball of Comparative Example 10 is a conventional typical two-piece solid golf ball. This golf ball of Comparative Example 10 exhibits a large flying distance, as shown in Table 15, but the control properties at the time of iron shot are inferior. Further, the hit feeling is hard and inferior.

The golf ball of Comparative Example 12 is a commercially available thread wound golf ball with balata cover. Regarding this golf ball of Comparative Example 12, as shown in Tables 14 and 15, the control properties by means of iron are good and the hit feeling is soft, but the durability is inferior. Further, the flying distance is small in comparison with the two-piece golf ball of Comparative Example 10.

Then, the characteristics of the golf balls of Examples 1 to 13 of the present invention will be explained in comparison with the typical two-piece solid golf ball of Comparative Example 10 and the commercially available thread wound golf ball with balata cover of Comparative Example 12. As shown in Tables 1 to 9, the golf balls of Examples 1 to 13 of the present invention exhibit a large flying distance which is almost the same as that of the conventional typical two-piece solid golf ball of Comparative Example 10, and the durability is superior to the golf ball of Comparative Example 10.

Further, the golf balls of Examples 1 to 13 of the present invention are superior in control properties at the time of iron shot and the hit feeling is also good. They are better than the commercially available thread wound golf ball with balata cover of Comparative Examples 12.

That is, the golf balls of Examples 1 to 13 of the present invention exhibit a large flying distance and is superior in stability at the time of iron shot and hit feeling.

On the contrary, the golf balls of Comparative Examples 1 to 14 were inferior in flying distance, control properties at the time of iron shot or hit feeling.

For example, the golf ball of Comparative Example 7 is a golf ball wherein the inner layer cover is soft and the outer layer cover is hard. Since the outer layer cover is hard, the hit feeling is hard and inferior as shown in Table 13. Further, the golf ball is inferior in control properties by means of iron and lacks in stability of iron shot.

Further, the golf balls of Comparative Example 13 to 14 are golf balls wherein the inner layer cover is hard and the outer layer cover is soft. Since the outer layer cover is too soft, the low temperature durability is inferior, as shown in Table 14. Further, as shown in Table 15, the hit feeling is heavy and resiliency is inferior, and it is not preferred.

What is claimed is:

1. A golf ball comprising a core and a cover for covering said core, said cover comprising an inner layer cover and an outer layer cover, a stiffness modulus of the inner layer cover being 3,000 to 5,500 kg/cm$^2$, a stiffness modulus of the outer layer cover being 1,000 to 2,500 kg/cm$^2$, a thickness of the inner layer cover being 0.5 to 2.5 mm, a thickness of the outer layer being 0.5 to 2.5 mm, a total thickness of the inner layer cover and the outer layer cover being 1.0 to 4.5 mm, a base resin of the inner layer cover containing 5 to 100% by weight of an ionomer neutralized with a zinc ion, and a base resin of the outer layer cover containing 5 to 100% by weight of an ionomer.

2. The golf ball according to claim 1 wherein said outer layer cover has a stiffness modulus of 1,000 to 2,300 Kg/cm$^2$ and a thickness of 0.6 to 2.3 mm.

3. The golf ball according to claim 1 wherein said inner layer cover has a stiffness modulus of 3,200 to 5,000 Kg/cm$^2$ and a thickness of 0.6 to 2.3 mm.

4. The golf ball according to claim 1 wherein said core is either a thread-wound core or a solid core.

5. The golf ball according to claim 1, wherein said base resin of said inner layer cover comprises from 10 to 100% by weight of an ionomer neutralized with a zinc ion.

6. The golf ball according to claim 1, wherein said base resin of said outer layer cover comprises from about 50 to 100% by weight of an ionomer neutralized with a zinc ion.

* * * * *